United States Patent [19]

Reed

[11] Patent Number: 4,627,489

[45] Date of Patent: Dec. 9, 1986

[54] TOP ENTRY ELECTRICAL TRANSMISSION SAFETY ASSEMBLY FOR SUBMERSIBLE PUMPING

[75] Inventor: Lehman T. Reed, Bakersfield, Calif.

[73] Assignee: Midway Fishing Tool Co., Long Beach, Calif.

[21] Appl. No.: 671,114

[22] Filed: Nov. 13, 1984

[51] Int. Cl.[4] ..... E21B 33/03

[52] U.S. Cl. ..... 166/65.1; 166/88; 339/94 M

[58] Field of Search ..... 166/65 R, 88, 89, 75 A, 166/77, 77.5, 85, 379; 174/151, 158 R, 47–49; 339/217 R, 15, 16 C, 16 R, 16 RC, 60 C, 117 R, 94 M

[56] References Cited

U.S. PATENT DOCUMENTS

| | | | |
|---|---|---|---|
| 3,489,439 | 1/1970 | Word, Jr. | 166/89 |
| 3,871,734 | 3/1975 | Murtland | 339/94 M |
| 4,154,302 | 5/1979 | Cugini | 166/88 X |
| 4,289,199 | 9/1981 | McGee | 166/88 X |
| 4,491,176 | 1/1985 | Reed | 166/65 R |

*Primary Examiner*—Stephen J. Novosad
*Assistant Examiner*—Thuy M. Bui
*Attorney, Agent, or Firm*—William C. Babcock; William C. Babcock

[57] ABSTRACT

A top entry electrical transmission safety assembly for removably effecting electrical communication through a tubing hanger, between an above ground electric power supply cable and an electric power receiving cable that extends upwardly from a motor driven submersible pump in a bore hole. The electric power supply portion of the assembly may be removed from the tubing hanger without removing the latter from a supporting well head. The supporting well head has a bonnet removably secured thereto through which the electric power supply cable extends, which bonnet not only serves its normal function, but acts in a safety capacity to prevent the electrical transmission assembly being uncoupled inadvertently to create an electric arc or spark in a hazardous potentially explosive area such as on an off shore platform or island. The electrical transmission assembly can only be uncoupled after the electric power supply cable has been disconnected from the source of electric power; the electric power supply cable disengaged from the bonnet; and the bonnet removed from the well head.

8 Claims, 7 Drawing Figures

FIG. 3
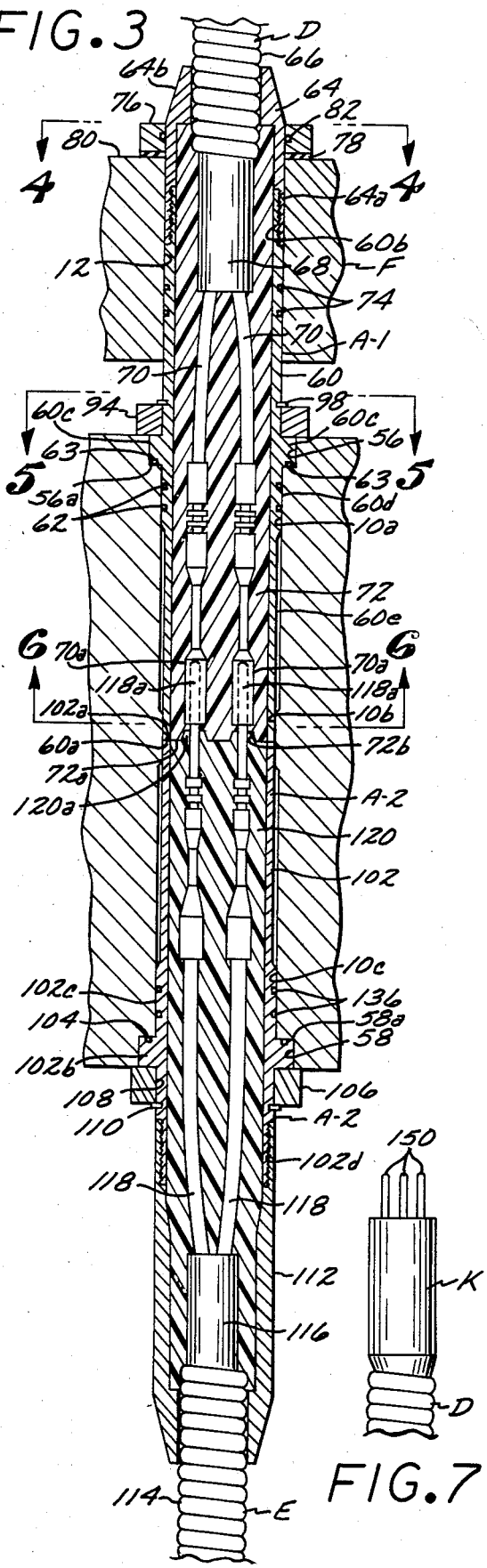
FIG. 7
FIG. 4
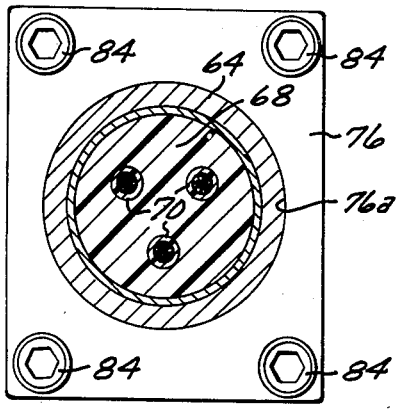
FIG. 5
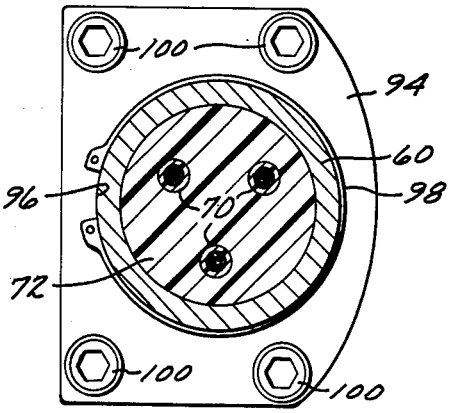
FIG. 6
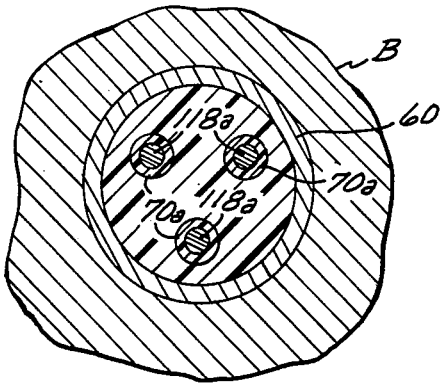

TOP ENTRY ELECTRICAL TRANSMISSION SAFETY ASSEMBLY FOR SUBMERSIBLE PUMPING

BACKGROUND OF THE INVENTION

In the past, electrical power receiving cables from downhole pumps and the like have extended upwardly through bores in tubing hangers or through cable feed throughs in the tubing hanger to a source of electric power. Such installations have the operational disadvantage that when it is necessary to perform maintenance work on the electrical connection within the tubing hangers, the latter must be lifted upwardly from the well heads in which they are disposed. Lifting of a tubing hanger, together with a tubing string supported therefrom, can only be accomplished by use of an expensive power operated mobile unit. Lifting of the tubing hanger even in relatively shallow wells can cost thousands of dollars.

An example of a well head feed through of the above described type that has been used extensively is disclosed in U.S. Pat. Nos. 3,437,149 entitled: "Cable Feed Through Means and Method for Well Head Construction" which patent issued Apr. 8, 1969 to Edward T. Cuginino. This device has the operational disadvantages previously mentioned. In my patent application Ser. No. 432,300, filed Oct. 1, 1982 entitled: "Electric Power Supplying Well Head Assembly", I disclosed and claimed a side entry assembly for effecting electrical communication through a tubing hanger supported in the well head, and the electric power supply portion of the assembly capable of being removed from the tubing hanger for maintenance purposes without removing the tubing hanger from the well head.

Subsequently in the United States patent application entitled:"Top Entry Electrical Transmission Assembly for Submersible Pumping", I disclosed and claimed a second invention for establishing electrical communication between an above ground source of electric power and a submersible pump, which second invention was removably mounted in a tubing hanger and could be removed for maintenance purposes without removing the tubing hanger from a supporting well head.

In both of my prior electrical connection assemblies, it was possible to uncouple the same for maintenance purposes without terminating the flow of electric power therethrough, and as a result arcing or sparking could take place that would be extremely dangerous if it occurred in a potentially hazardous area in which hydrocarbon fumes were present such as on an off shore platform or island.

A major object of the present invention is to provide a top entry electrical transmission assembly that is removably mountable in a well head supported tubing hanger to supply electric power from a source above ground to a submersible pump, and one that can be removed from the tubing hanger without removing the latter from a supporting well head, but only after the electric supply cable has been disconnected from a switchboard or source of electric power, the electric power supply cable separated from the bonnet, and the bonnet removed from the well head, and by so doing eliminating the possibility of an electric arc being inadvertently formed in a potentially hazardous explosive area.

A major object of the present invention is to provide a top entry electric transmission safety assembly for submersible pumping that is simple and easy to use and that eliminates the possibility of electric arcing and sparking occurring in a hazardous area.

These and other objects and advantages of the invention will become apparent from the following description of the preferred form thereof.

REFERENCE TO RELATED PATENT APPLICATIONS

U.S. patent application Ser. No. 432,300, entitled: "Electric Power Supplying Well Head Assembly", filed Oct. 1, 1982.

U.S. patent application Ser. No. 666,291, filed Oct. 29, 1984 entitled: "Top Entry Electric Transmission Assembly for Submersible Pumping".

SUMMARY OF THE INVENTION

The present invention is used in combination with a well head that removably supports a tubing hanger within the interior thereof and from which tubing hanger a tubing string depends downwardly in a bore hole to an electrically operated submersible pump that has an electric power receiving cable extending upwardly therefrom to a position adjacent the tubing hanger. The tubing hanger has a first vertical bore therein. The well head has a bonnet removably secured to the upper end thereof, which bonnet has a second vertical bore therein that is co-axially aligned with the first bore. The top entry electrical transmission safety assembly of the present invention is removably mounted in the first and second bores, and receives electric power from the electric power supply cable that is removably secured to a switchboard or other source of electric power and is connected to the portion of the assembly extending above the bonnet.

The assembly of the present invention includes an elongate electric power receiving element secured to the electric power receiving cable and that extends upwardly in the first bore to terminate in an upper end from which a number of transversely spaced, metallic elongate engageable electrical conducting members project. The assembly also includes an elongate electric power supply element secured to the electric supply cable, and which element is capable of being slidably inserted in the first bore, and when so inserted a number of elongate metallic electrical conducting engaging members on the lower end thereof are removably coupled to the engageable members.

To mount the bonnet on the well head, the electric power supply cable must be drawn longitudinally through the second bore. The second bore preferably has a protective sleeve removably mounted therein to protect the metal defining the second bore from abrasion as the electric power supply cable is drawn therethrough.

The protective sleeve is removed from the second bore prior to the bonnet being lifted and then lowered downwardly on the well head for the electric power supply element to occupy the second bore and extend above the bonnet. The protective sleeve is now slid longitudinally on the electric power supply cable and removed therefrom. The free end of the electric power supply cable that has a conventional electrical connector secured thereto is threaded through a sealing member, which sealing member is moved longitudinally on the electric power supply cable to a position where it is removably secured to the upper surface of the power supply cable that has a conventional electrical connector secured thereto is threaded through a sealing member, which sealing member is moved longitudinally on the electric power supply cable to a position where it is removably secured to the upper surface of the bonnet. The sealing member is then in sealing engagement with both the upper surface of the bonnet and the portion of the electric power supply element that extends thereabove. The connector on the free end of the electric power supply cable may now be connected to the power supply switchboard with the assurance that no inadvertent electrical sparking will occur.

When it is desired to perform maintenance work on the electric power supply element it may be separated from the tubing hanger by reversing the above described sequence of steps.

BRIEF DESCRIPTION OF THE DRAWINGS

FIG. 3 is a longitudinal cross sectional view of the top entry electrical transmission safety assembly taken on the line 3—3 of FIG. 1;

FIG. 4 is a combined top plan view and transverse cross sectional view of the invention taken on the line 4—4 of FIG. 3;

FIG. 5 is a combined top plan view and transverse cross sectional view of the invention taken on the line 5—5 of FIG. 3; and FIG. 6 is a transverse cross sectional view of the invention taken on the line 6—6 of FIG. 3.

FIG. 7 is an enlarged portion of the electrical power supply cable and a conventional connector.

DESCRIPTION OF THE PREFERRED EMBODIMENT

Figure 1:
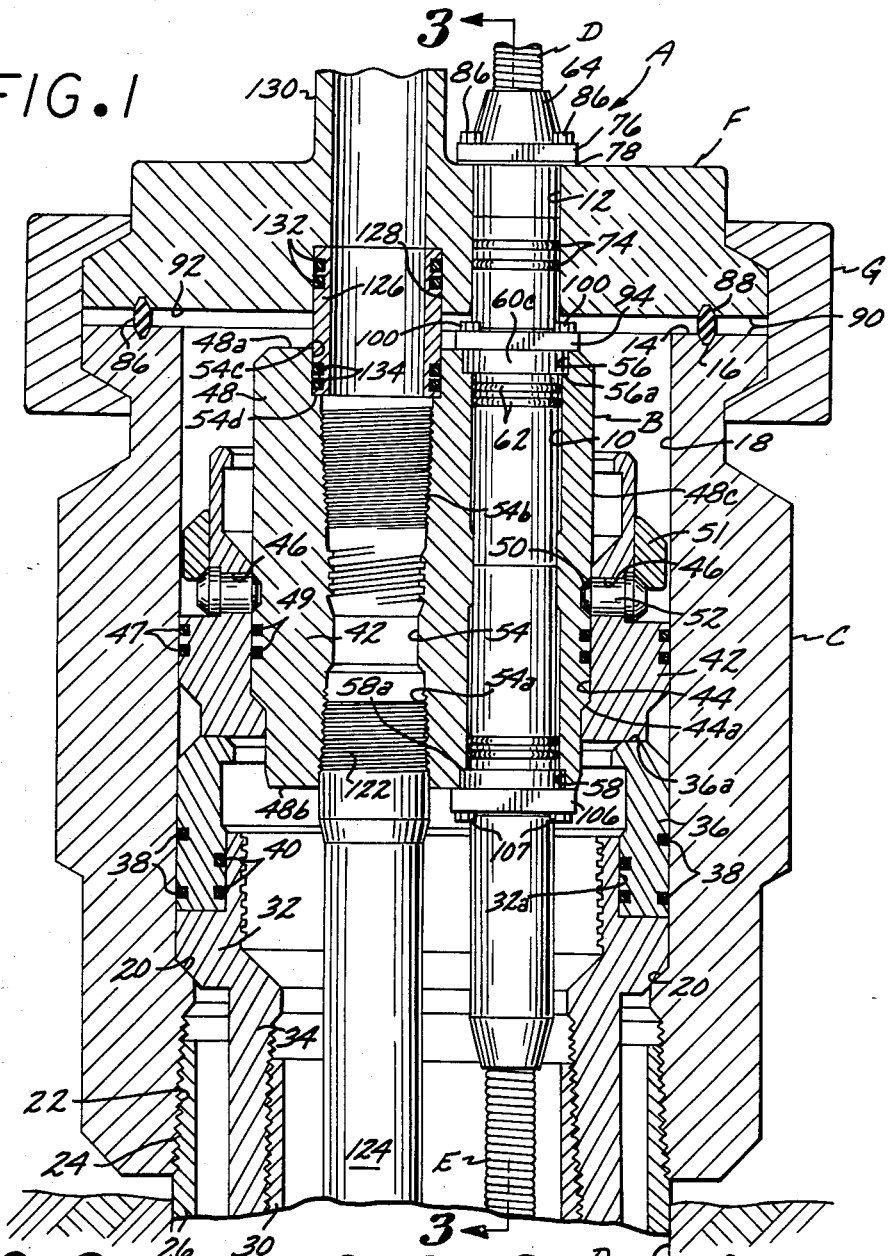
FIG. 1 is a vertical cross sectional view of the top entry electrical transmission safety assembly removably mounted in a well head supported tubing hanger to effect electrical communication between an electrical power supply cable and electric power receiving cable.

The top entry electrical transmission safety assembly A as may be seen in FIG. 1, includes an electric power supply element A-1 and an electric power receiving element A-2 that are removably coupled together. The power receiving element A-2 extends upwardly in a first vertical bore in a tubing hanger B that is supported in a well head C.

Well head C has a bonnet F removably secured to the upper end thereof by a conventional clamp G. Bonnet F has a second vertical bore 12 therein through which the electrical power supply element A-1 extends upwardly.

The element A-1 is connected to an above ground electric power supply cable D, which cable in turn is removably connected to a source of electric power (not shown) by a conventional connector K. The elements A-1 and A-2 may be uncoupled from one another without lifting tubing hanger B above well head C. However, such uncoupling can occur only after the electric power supply cable D is disconnected from the source of electric power (not shown); bonnet F separated from well head C; and the bonnet disengaged from electrical supply cable D and connector K by the cable and connector being drawn longitudinally through the second bore 12.

The electric power supply element A-1 may now be uncoupled from electric power receiving element A-2 in a potentially hazardous environment without danger of electrical sparking or arcing occuring as the uncoupling takes place. The elements A-1 and A-2 are coupled together by reversing the above described step. When the electric power supply cable D is moved longitudinally relative to the second bore 12, the metal defining the second bore is preferably protected from abrasive damage by a protective sleeve as will later be described in detail.

The well head C is illustrated in FIG. 1, as including a flat ring shaped upper surface 14 that has a first circular groove 16 therein, and the well head having a cylindrical interior surface 18 that develops in the lower portion thereof into an inwardly extending body shoulder 20, which body shoulder has threads 22 defined therebelow.

The threads 22 of the well head C engage threads 24 formed on the upper exterior end portion of a surface casing string 26 that extends downwardly in a bore hole 8 as shown in FIG. 1. An inner casing string 30 is threadedly connected to a cylindrical shell 34 that forms a part of a casing hanger 32 that has a circular recess **32*a* formed in the upper portion thereof. The casing hanger 32 as shown in FIG. 1, removably rests on the body shoulder 20. A ring shaped tubing hanger support 36 has the lower portion thereof disposed in the recess 32*a* as illustrated in FIG. 1**.

The tubing hanger support 36 has grooves formed in the exterior surface thereof that are vertically spaced from one another and have sealing rings 38 mounted therein that seal with the interior cylindrical surface 18 of the well head C. The lower interior portion of the tubing hanger support 36 also has circumferentially extending grooves therein in which sealing rings 40 are disposed that seal with the part of the casing hanger 32 that defines the recess **32*a***.

The tubing hanger B as can be seen in FIG. 1, includes an outer generally cylindrical shell 42 that has an inner cylindrical surface 44, with the inner surface developing in the lower portion thereof into a downwardly and inwardly extending body shoulder **44*a*. The shell 42 has a number of circumferentially spaced transverse bores 46 therein. The tubing hanger B also includes an inner rigid cylindrical body 48 that has a top end surface 48*a*, a bottom surface 48*b*, and a cylindrical exterior surface 48*c* that extends therebetween. The body 48 has a number of circumferentially spaced recesses 50 formed therein as shown in FIG. 1, that are removably engaged by pins 52 that are mounted in the bores 46. The pins 52 are removably maintained in bores 46 by a lock ring 51. The shell 42 as may be seen in FIG. 1 has a number of circumferentially spaced grooves defined thereon that support sealing rings 47 that are in sealing contact with the cylindrical surface 18**.

The cylindrical surface **48*c* has grooves therein that support sealing rings 49 that are in pressure sealing contact with the interior surface of the shell 42. A vertically extending passage 54 is defined in the tubing hanger body 48, with the passage having a lower threaded end portion 54*a*, and an upper threaded end portion 54*b*. The passage has a cylindrical portion developing into an inwardly extending body shoulder 54*d* as shown in FIG. 1**.

The upper and lower end portions of the first bore 10 are defined by upper and lower circular recesses 56 and 58 formed in the body 48, and the recesses cooperating with the first bore 10 to define upper and lower circular body shoulders 56*a* and 58*a* that may best be seen in FIG. 1.

The electric power supply element A-1 as shown in FIG. 3 includes an elongate rigid tubular shell 60 that has a lower end 60*a* and a threaded upper end 60*b*. The shell 60 has a circular collar 60*c* projecting outwardly therefrom and intermediately located between the upper and lower ends 60*a* and 60*b*. The shell 60 includes a first section 60*d* below the collar 60*c* that snuggly and slidably engages a first upper section 10*a* of bore 10 below the upper recess 56. The tubular shell 60 includes a second section 60*e* below the first section 60*b* that is of small diameter and slidably engages an intermediate section 10*b* of the first bore 10 that is of smaller diameter than the bore section 10*a*. The tubular section 60*d* has a pair of vertically spaced, circumferentially extending grooves therein in which sealing rings 62 are disposed that are in slidable sealing contact with the section 10*a* of bore 10. The collar 56 supports a sealing ring 63 on the lower surface thereof that is in sealing abutting contact with the body shoulder 56*a* as shown in FIG. 3.

The electric power supply element A-1 also includes a tubular end cap 64 that has an interior threaded end portion 64*a* that engages the threaded upper end portion 60*b* as shown in FIG. 3. The end cap 64 also includes a cable engaging end portion 64*b* that is best seen in FIG. 3. The electric power supply cable D has a armored exterior 66 that extends into the end cap 64, the armored exterior 66 envelopes a core of electrical insulating material 68, which core extends into the tubular shell 60. Three elongate metallic electrical conductors 70 extend into the tubular shell 60 from the electric supply cable D, with the conductors 70 on the lower ends as viewed in FIG. 3 being connected to three elongate engaging members 70*a* in the form of sockets. The engaging member 70*a* and the conductors 70 are held in fixed spaced relationship within the shell 60 by being embedded in a body 72 of an electrical insulating material such as an epoxy or the like.

The body 72 as shown in FIG. 3 has a lower end surface 60*a*. The body 72 has three tapered openings 72*b* extending upwardly from the lower end surface 72*a* and communicating with the interior of the sockets 70*a*. A portion of the tubular member 60 situated within the second bore 12 has a number of resilient sealing rings 74 mounted thereon that slidably and sealingly engage the metal defining the second bore 12 as may be seen in FIG. 3.

In FIG. 3 it will be seen that the end cap 64 extends upwardly through an opening (not shown) in a resilient gasket 78 that rests on the upper surface 80 of the bonnet F. A square first rigid plate 76 that has a transverse bore 76*a* therein through which the end cap 64 extends upwardly overlies the gasket 78 as shown in FIG. 3. A sealing ring 82 is situated in bore 76*a* and is in pressure contact with end cap 64.

In FIG. 4 four bolts 84 are shown that extend downwardly through vertically aligned bores (not shown) in plate 76 and gasket 78 to engage four tapped recesses (not shown) that extend downwardly in body 48 from the upper end surface 48*a* thereof. Plate 76, gasket 78, sealing ring 82, and sealing rings 74 cooperate to prevent moisture moving longitudinally in the second bore 12 to enter the interior of the electric power supply element A-1 between the threaded portions 60*b* and 64*a*.

In FIG. 1 it will be seen that the first groove 16 is engaged by a spacer ring 86 that engages a second groove 88 in the lower surface 92 of bonnet F, and as a result the bonnet F is separated from the well head C by a space 90.

The collar 60*c* of the electric power supply element A-1 is of such thickness that when removably disposed in recess 56 the sealing ring 63 is in pressure contact with body shoulder 56*a*. A retaining plate 94 has a transverse bore 96 therein through which the electric power supply element A-1 extends upwardly as shown in FIG. 3, with the retaining plate overlying the collar 60*c* to removably maintain the latter in recess 56. A snap ring 98 engages a groove in tubular shell 60 as well as the upper surface of retaining plate 94 to maintain the retaining plate at a fixed longitudinal position on the electric power supply element A-1.

The retaining plate 94 has four spaced openings (not shown) through which bolts 100 illustrated in FIG. 1 extend downwardly to engage tapped cavities (not shown) formed in the hanger body 48 and secure the electric power supply element A-1 to tubing hanger D.

The electric power receiving element A-2 as best seen in FIG. 3 includes a tubular shell 102 that has an upper end 102*a* and an outwardly extending circular collar 102*b* situated therebelow. A section 102*c* of shell 102 above collar 102*b* slidably and snuggly engages bore section 10*b*. Collar 102*b* has a resilient sealing ring 104 mounted on the upper surface thereof that is in pressure sealing contact with body shoulder 58*a*. A second retaining plate 106 has a transverse bore 108 therein through which the electric power receiving element A-2 extends upwardly as shown in FIG. 3. A snap ring 110 removably engages a groove in the shell 102 to maintain the retaining plate 106 in abutting contact with collar 102*b*. The second retaining plate 106 is of the same size and structure as the first retaining plate 94 and is interchangeable therewith. The second retaining plate 106 is removably secured to the under surface of tubing hanger body 48 by bolts 107 as shown in FIG. 1.

The tubular shell 102 has a lower threaded end 102*d* best seen in FIG. 3 that is threadedly engaged by a tubular end cap 112 that extends over the armored exterior 114 of the electric power receiving cable E. The cable E has a core 116 of electrical insulating material in which three electrical conductors 118 are embedded, and the conductors on their upper ends as viewed in FIG. 3 being connected to three elongate electrical conducting engageable members 118*a* which are illustrated as being prongs.

The tubular shell 102 and end cap 112 are filled with a body 120 of electrical insulating material such as an epoxy or the like. The body 120 on the upper end thereof defines a number of upwardly extending tapered guide portions 120*a* that are adapted to seat in recesses 72*b* as shown in FIG. 3 when the elements A-1 and A-2 are in coupled engagement.

The tubing string 124 as shown in FIG. 1 has an upper threaded end portion 122 that engages the threads 54*a* to support the tubing string in a depending position from the hanger B. Passage 54 has an upper threaded portion 54*b* that may be engaged by a threaded mandrel (not shown) to lift the tubing hanger B from well head C when the bonnet F is removed therefrom.

A tubular sleeve 126 engages passage portion 54c and extends upwardly therefrom to engage a passage 128 in bonnet F. The bonnet F is illustrated in FIG. 1 as including a tubular passage extension 130 that receives well fluid from the tubing string 124. The sleeve 126 has upper and lower sealing rings 132 and 134 on the exterior thereof that seal with bonnet F and tubing hanger B as shown in FIG. 1. Sealing rings 136 are mounted on the exterior surface of electric power receiving element A-2.

Figure 2:
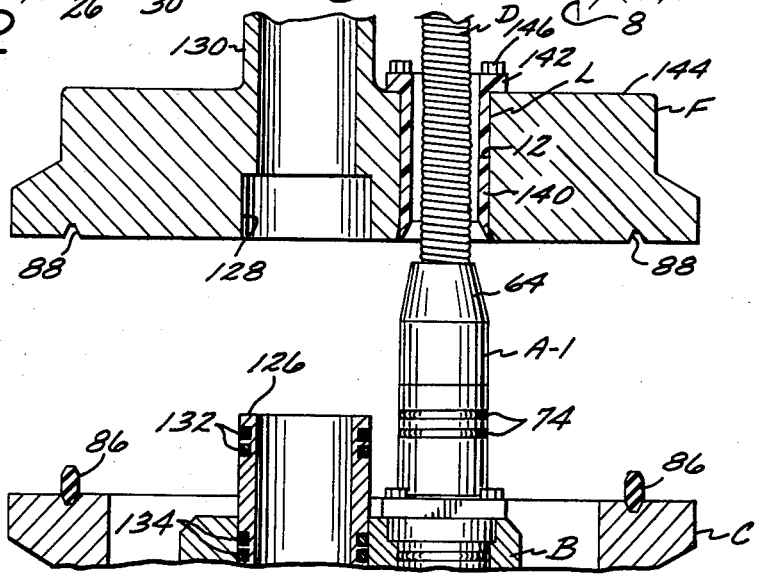
FIG. 2 is a portion of the view shown in FIG. 1 but with the bonnet removed from the well head and illustrating the protective sleeve mounted in the bonnet to prevent abrasive contact of the electric supply cable with the bonnet as the cable is moved longitudinally relative thereto.

In FIG. 2 a protector L is shown that may be removably mounted in the second bore 12 to protect the portion of bonnet F that defines the same from being scratched or abraded as the electric power supply cable D is drawn longitudinally therethrough for reasons that will later be described. Protector L is preferably formed from plastic or the like and includes a tubular member 140 that is snuggly and slidably insertable into the second bore 12. The tubular member 140 has a flange 142 extending outwardly from the upper end thereof that is in abutting contact with the upper surface 144 of bonnet F. Bolts 146 extend through spaced bores (not shown) in flange 142 to engaged tapped cavities (not shown) in bonnet F to removably maintain the protector on the bonnet as shown in FIG. 2. The tubular member 140 has a bore 148 extending longitudinally therethrough that has a diameter sufficiently large as to permit the electric power supply cable and connector K shown in FIG. 7 to be drawn therethrough. The connector K is of conventional structure and includes three electrical conducting prongs 150 that can engage an electrical outlet at a switchboard or other source of electric power (not shown).

The top entry electrical transmission safety assembly A is shown in an operating condition in a well head for supplying electrical energy from cable D to cable E through the tubing hanger B. In use, the element A-2 is secured to the tubing hanger B by bolts 107 and the tubing hanger then lowered downwardly in the well head C to occupy the position shown in FIG. 1.

The first element A-1 is now moved downwardly in first bore 10 for the electrical conducting sockets 70a to slidably engage the prongs 118a. The first and second elements A-1 and A-2 are of such length that when sockets 70a and prongs 118a are in full engagement collar 60c is substantially disposed in recess 56, with first plate 94 being in abutting contact with the collar. By tightening the bolts 100, the plate 94 and collar 60c are moved downwardly relative to tubing hanger B, and the sealing ring 63 forced into pressure sealing contact with the body shoulder 56a.

Sealing ring 63 and sealing rings 62 as may be seen in FIG. 3 prevent water or moisture migrating downwardly in first bore 10. Sealing rings 58a and 136 serve the same function, and prevent water or moisture migrating upwardly in first bore 10. Due to the above described seals, the sockets 70a and prongs 118a are protected from corrosion by moisture and water, as well as corrosive fumes from the bore hole 8.

The protector L is now mounted on the bonnet F as shown in FIG. 2, and the connector K and electric power supply cable D pulled longitudinally therethrough. The bolts 146 are now removed from the protector L. Bonnet F is now lowered on the well head C with the sleeve 126 entering the recess 128 and the upper portion of first element A-1 entering the second bore 12 to displace the protector L therefrom. Ring 86 enters groove 88 to support the bonnet F above well head C. Clamp G is now caused to engage the bonnet F and well head C as shown in FIG. 1.

The sealing rings 74 are in pressure contact with the portion of the bonnet F that defines the second bore 12, which portion is free of scratches or abrasions due to the protector L being in place as the armored exterior 66 of cable D is moved longitudinally relative to the second bore. In FIG. 3 it will be seen that the sealing rings 74 are situated below the engaging threaded portions 60b and 64a of first element A-1, and as a result water or moisture cannot migrate upwardly in the second bore 12 to enter the interior of element A-1 in the space between these threaded portions.

The protector L is now slid from the electric power supply cable D. Gasket 78 and plate 76 are now moved longitudinally along the electric power supply cable D and disposed as shown in FIG. 3, with the gasket being in abutting contact with the upper surface 80 of bonnet F.

Plate 76 is now secured to the bonnet F by bolts 86 as shown in FIG. 1. Bolts 86 when tightened compress gasket 78 and force it into sealing contact with the upper surface 80 of bonnet F. Plate 76 supports a sealing ring 82 that is in pressure contact with the exterior surface of end cap 64. The gasket 78 and sealing ring prevent the entry of moisture or water into the upper portion of second bore 12 and the space between the threaded portions 60b and 64a. The assembly A is now in condition to have the connector K inserted in a switchboard or other source of electric power (not shown) to supply power to the cable E.

In FIG. 1 it will be seen that the bonnet F prevents the bolts 100 being unscrewed from tubing hanger B when the assembly A is supplying electric power to cable E. Unscrewing of the bolts 100 is necessary to permit separation of first element A-1 from second element A-2.

The assembly A cannot have the first element A-1 inadvertently separated from the second element A-2 when electric power is being supplied to the cable E.

The first element A-1 can be uncoupled from the second element A-2 for inspection and maintenance, but only after connector K has been removed from electrical communication with the source of electric power (not shown).

After the connector K has been disconnected, the bolts 86 are loosened, and the plate 76 and gasket 78 are slid longitudinally from the electric power supply cable D and connector K. The protector L is now slid longitudinally along the cable D to a position adjacent bonnet F. Clamps G are now removed from engagement with bonnet F and well head C.

The bonnet B now has the protector L inserted in the second bore 12 as shown in FIG. 2, and secured to the bonnet by bolts 146. The bonnet F is now moved relative to the well head C to a position where the electric supply cable D and connector K can be moved longitudinally through the protector L and separated. During this operation the protector L prevents the armored exterior 66 from scratching or abrading the metal of bonnet F that defines the second bore 12. Such scratching or abrading is undesirable. Scratching or abrading of the metal defining the second bore 12 prevents the sealing rings 74 effecting a moisture and watertight seal therewith when the sealing rings are disposed as shown in FIG. 1.

Bolts 100 are now removed to permit plate 94 to be separated from tubing hanger B. The first element A-1 may now be pulled upwardly and separated from the tubing hanger B to permit inspection or maintenance work to be performed on the first element.

The assembly A is returned to the operating condition shown in FIG. 1 by reversing the above described steps.

The use and operation has been described previously in detail and need not be repeated.

What is claimed is:

1. In a well head that removably supports a tubing hanger having upper and lower end surfaces in the interior thereof and from which tubing hanger a tubing string depends downwardly in a bore hole to an electrically operated submersible pump that has an electric power receiving cable extending upwardly therefrom in said bore hole to terminate in a first end at a position adjacent said lower end surface of said tubing hanger; a bonnet removably mounted on said well head; a source of electric power; an electric power supply cable that has first and second ends, said first end removably connected to said source of electric power, the combination with said well head of a top entry electrical transmission safety assembly of multiple part structure that is mounted in first and second aligned vertical bores in said tubing hanger and bonnet for supplying electric power to said electric power receiving cable from said electric power supply cable and that may have the portion thereof that extends through said second bore separated from the balance thereof for inspection and maintenance without removing said tubing hanger from said well head but only after said electric power supply cable has been disconnected from said source of electric power and said bonnet separated from said well head to prevent the possibility of sparking and arcing between the portions of said electrical transmission safety assembly in a potentially hazardous zone containing hydrocarbon fumes, said top entry electrical transmission safety assembly including:

a. an elongate electric power receiving element secured to said first end of said power receiving cable that extends upwardly in said first bore to terminate in an upper end and a plurality of transversely spaced, metallic, elongate engageable electrical conducting means on said upper end;

b. first means for securing said electric power receiving element in said tubing hanger to dispose said upper end in a predetermined intermediate position in said first bore between said upper and lower end surfaces of said tubing hanger;

c. an elongate electric power supply element secured to said second end of said electric power supply cable that is removably mounted in said first bore, said electric power supply element including a lower end that has a plurality of elongate, electrical conducting metallic engaging means projecting therefrom that slidably engage said engageable means, said electric power supply element of sufficient length as to project upwardly through said second bore to a position above said bonnet when the latter is mounted on said well head after said electric power supply cable has been threaded through said second bore;

d. second means for removably securing said electric power supply element to said tubing hanger when said second means is in a first position, with said second means incapable of being moved to a second position to permit said electric power supply element to be removed from said tubing hanger when said bonnet is mounted on said well head; and e. third means for removably securing said bonnet to said well head, with said electric power receiving cable receiving electric power when said first end of said electric power supply cable is connected to said source of electric power, with said electric power supply element incapable of being inadvertently separated from said electric power receiving element to cause sparking in a potentially hazardous zone containing hydrocarbon fumes due to said separation capable of being carried out until after said third means has been released from engagement with said bonnet and well head, said first end of said electric power supply cable has been disconnected from said source of electric power, said bonnet separated from said well head, said electric power supply cable drawn through said second bore to separate it from said bonnet, and said second means moved to said second position to permit said electric power supply element to be withdrawn from said first bore and uncoupled from said electric power receiving element.

2. A top entry electrical transmission assembly as defined in claim 1 upper and lower portions that are threadedly connected to one another within said second bore at a threaded junction, with said top entry electrical transmission safety assembly in addition including:

f. first sealing means below said threaded junction for preventing migration of moisture upwardly in said second bore to said threaded junction; and g. second sealing means removably mounted on said bonnet above said threaded junction to prevent migration of moisture downwardly in said second bore to said threaded junction.

3. A top entry electrical transmission safety assembly as defined in claim 2 which in addition includes:

h. a protective sleeve that is moved longitudinally on said electric power supply cable after the latter is disconnected from said source of electric power and said second means has been separated from said bonnet and electric power supply cable to occupy said second bore and protect the material of said bonnet defining same from scratching when said bonnet is moved to separate said bonnet from said well head and electric power supply cable and said protective sleeve also protecting said material defining said second bore from scratching when said electric power supply cable is drawn therethrough as said bonnet is moved towards said well head prior to said bonnet being mounted on said well, with said protective sleeve being removed from said electric power supply cable after mounting of said bonnet on said well head has been completed, with said second means then mounted on said bonnet prior to said electric power supply cable being connected to said source of electric power.

4. A top entry electrical transmission safety assembly as defined in claim 1 in which said electric power receiving element includes a collar that extends outwardly therefrom and which when in abutting contact with said lower end surface of said tubing hanger disposes said upper end of said electric power receiving element at said predetermined intermediate position, and said first means being:

f. a plate slidably movable on said electric power receiving element and that abuts against said collars; and g. a plurality of bolts that extend upwardly through a plurality of openings in said plate to engage a plurality of tapped cavities in said tubing hanger to removably secure said plate to said tubing hanger in abutting contact with said collar.

5. A top entry electrical transmission safety assembly as defined in claim 4 which in addition includes:

h. sealing means on said collar for preventing migration of moisture and fumes from said bore hole upwardly through said first bore.

6. A top entry electrical transmission safety assembly as defined in claim 1 in which said electric power supply element includes a collar that extends outwardly therefrom and which when in abutting contact with said upper end surface of said tubing hanger disposes said lower end of said electric power supply element at said predetermined intermediate position, said second means including:

f. a plate slidably movable on said electric power supply element and that abuts against said collar; and g. a plurality of bolts that extend downwardly through a plurality of openings in said plate to engage a plurality of tapped cavities in said tubing hanger to removably secure said plate to said tubing hanger in abutting contact with said collar.

7. A top entry electrical transmission safety assembly as defined in claim 5 which in addition includes:

h. sealing means on said collar for preventing migration of moisture downwardly in said first bore.

8. A top entry electrical transmission safety assembly as defined in claim 1 in which said engageable and engaging means are in the form of prongs and sockets.

* * * * *